US010522929B2

(12) United States Patent
Shimba et al.

(10) Patent No.: US 10,522,929 B2
(45) Date of Patent: Dec. 31, 2019

(54) CONNECTOR TO PROVIDE RELIABLE ELECTRICAL CONNECTION

(71) Applicant: IRISO ELECTRONICS CO., LTD., Yokohama-shi, Kanagawa (JP)

(72) Inventors: Daichi Shimba, Yokohama (JP); Yoshiyuki Ogura, Yokohama (JP); Hitoshi Tanaka, Yokohama (JP)

(73) Assignee: IRISO ELECTRONICS CO., LTD., Yokohama-Shi, Kanagawa (JP)

( * ) Notice: Subject to any disclaimer, the term of this patent is extended or adjusted under 35 U.S.C. 154(b) by 0 days.

(21) Appl. No.: 16/152,484

(22) Filed: Oct. 5, 2018

(65) Prior Publication Data

US 2019/0109396 A1 Apr. 11, 2019

(30) Foreign Application Priority Data

Oct. 6, 2017 (JP) ..... 2017-195723

(51) Int. Cl.
*H01R 13/11* (2006.01)
*H01R 12/71* (2011.01)
(Continued)

(52) U.S. Cl.
CPC ..... *H01R 13/112* (2013.01); *H01R 12/716* (2013.01); *H01R 12/91* (2013.01); *H01R 13/502* (2013.01)

(58) Field of Classification Search
CPC .. H01R 12/91; H01R 13/6315; H01R 13/112; H01R 13/502; H01R 12/716
(Continued)

(56) References Cited

U.S. PATENT DOCUMENTS 3,199,066 A * 8/1965 Eledge ..... H01R 12/716 439/857
4,795,379 A 1/1989 Sasaki et al.
(Continued)

FOREIGN PATENT DOCUMENTS

JP 6248787 U 3/1987
JP 2004119050 A 4/2004
(Continued)

OTHER PUBLICATIONS

Office Action dated Aug. 24, 2018, by the Japanese Patent Office for Application No. 2017-195723.

*Primary Examiner* — Travis S Chambers
(74) *Attorney, Agent, or Firm* — Buchanan Ingersoll & Rooney PC

(57) ABSTRACT

In a connector, a terminal has a pair of contact portions that are fixed to a housing and disposed so as to provide a stable and reliable electrical connection. In the connector, a movable housing has a first contact portion fixation groove that supports a first contact portion of the terminal and a second contact portion fixation groove that supports a second contact portion. The terminal has a link portion that can join the first contact portion and the second contact portion to each other so as to be able to adjust the clearance therebetween. The link portion can absorb a variation in the clearance between the first contact portion fixation groove and the second contact portion fixation groove and a variation in the clearance between the first contact portion and the second contact portion.

14 Claims, 10 Drawing Sheets

(51) Int. Cl.
*H01R 13/502* (2006.01)
*H01R 12/91* (2011.01)

(58) Field of Classification Search
USPC ..... 439/247, 246, 856, 857, 342
See application file for complete search history.

(56) References Cited

U.S. PATENT DOCUMENTS

| | | | | |
|---|---|---|---|---|
| 7,381,071 | B2 * | 6/2008 | Hayashi | H01R 13/112 439/246 |
| 9,397,432 | B2 * | 7/2016 | Yukutake | H01R 13/46 |
| 10,193,260 | B1 * | 1/2019 | Suzuki | H01R 13/10 |
| 2006/0019506 | A1 | 1/2006 | Harasawa | |
| 2012/0122350 | A1 | 5/2012 | Choi et al. | |
| 2016/0294111 | A1 * | 10/2016 | Kobayashi | H01R 13/187 |

FOREIGN PATENT DOCUMENTS

| | | | |
|---|---|---|---|
| JP | 2012532422 | A | 12/2012 |
| JP | 6325720 | B1 | 5/2018 |

* cited by examiner

CONNECTOR TO PROVIDE RELIABLE ELECTRICAL CONNECTION

BACKGROUND OF INVENTION

1. Field of the Invention

The present invention relates to a connector that includes a terminal having a pair of contact portions that come into contact with a connection object and also includes a structure for retaining the contact portions in a housing.

2. Description of the Related Art

A known connector used for electronic devices is constituted by a terminal having a pair of contact portions that come into contact with a connection object and also includes a structure for retaining the contact portions in a housing (for example, Japanese Unexamined Patent Application Publication No. 2004-119050). Such a known connector includes the housing and the terminal. In the terminal, contact portions and a support base are formed. The contact portions nip the connection object so as to come into electrical contact therewith, and the support base supports the contact portions in an elastically displaceable manner. The contact portions have respective elastic contact portions that are formed as flat plates and paired with each other. A pair of the elastic contact portions nip the connection object. A pair of the elastic contact portions are connected to a corresponding pair of flat fixation portions in such a manner that the flat surface of each elastic contact portion continues to the corresponding flat surface of each fixation portion. These fixation portions serve as a support base. A pair of the flat fixation portions continue to a link portion, which is also formed as a flat plate. The flat fixation portions are bent from the link portion at respective opposing edges of the link portion. Accordingly, a pair of the fixation portions and the link portion are formed into a U-shape in the cross section. The terminal is fixed to the housing in such a manner that a pair of the fixation portions are press-fitted and fixed to respective terminal fixation grooves formed in the housing.

The known connector has a terminal structure in which each of the fixation portions is bent from the link portion. Accordingly, the clearance between a pair of the fixation portions varies within tolerance limits depending on the accuracy of metalworking in bending each fixation portion from the link portion. The clearance is not always the same between the terminals manufactured.

The same applies to the housing. The clearance between a pair of the terminal fixation grooves to which a pair of the fixation portions of the terminal are press-fitted also varies within tolerance limits depending on the accuracy of resin molding of the housing. For example, even though the clearance between a pair of the fixation portions of the terminal may stay near the lower limit of the tolerance, if the clearance between a pair of the terminal fixation grooves may stay near the upper limit of tolerance, the support base has to be press-fitted to the housing in such a manner that the support base deforms so as to increase the clearance between the fixation portions (i.e., so as to widen the U-shape in the cross section).

A pair of the elastic contact portions extending from respective fixation portions of the support base are designed to position with the opposing surfaces parallel to each other. However, the deformation of the support base causes the surfaces of the elastic contact portions to be inclined relative to each other. Consequently, the elastic contact portions nip the connection object and come into electrical contact therewith in the inclined state. This may lead to a contact failure in which one of the elastic contact portions presses the connection object at an excess contact pressure. This may also lead to a contact failure in which the other elastic contact portion cannot press the connection object at a predetermined contact pressure or may not press the connection object at all. As a result, it becomes difficult to ensure reliable electrical connection.

SUMMARY OF THE INVENTION

The present invention is conceived with the above-described background. Accordingly, it is an object of the present invention to provide a connector in which a terminal has a pair of contact portions that are fixed to a housing and come into contact with a connection object and also to enable a pair of the contact portions to be placed appropriately so as to provide a reliable electrical connection even if the clearance between a pair of the contact portions of the terminal and the clearance between a pair of terminal fixation grooves of the housing vary within tolerance limits.

The present invention provides a connector having following features.

The connector according to the invention includes a terminal that has a first contact portion and a second contact portion disposed so as to be separated from the first contact portion and that is electrically connected to a connection object to be inserted to a position between the first contact portion and the second contact portion. The connector also includes a first housing that has a first terminal-retaining portion that retains the first contact portion and a second terminal-retaining portion that retains the second contact portion. In the connector, the terminal further includes a link portion that joins the first contact portion and the second contact portion to each other and that deforms so as to change a contact portion clearance between the first contact portion and the second contact portion in accordance with a retaining portion clearance between the first terminal-retaining portion and the second terminal-retaining portion.

According to this invention, the terminal has the link portion that deforms so as to change the contact portion clearance between the first contact portion and the second contact portion. Accordingly, when the terminal is installed in the first housing, deformation of the link portion can make the contact portion clearance larger or smaller so as to fit the retaining portion clearance even if the contact portion clearance of the terminal and the retaining portion clearance of the first housing vary within tolerance limits. As a result, the first contact portion and the second contact portion are installed appropriately in the first housing. The first contact portion and the second contact portion can be thereby brought into appropriate electrical contact with the connection object, which provides a reliable electrical connection.

The link portion may be configured to extend in at least one of inserting directions in which the first contact portion is inserted and fixed to the first terminal-retaining portion and in which the second contact portion is inserted and fixed to the second terminal-retaining portion. The link portion may also be configured to have a deformation portion that can deform in a direction intersecting the at least one of the inserting directions.

According to this invention, the link portion has the deformation portion that can deform in the direction intersecting the at least one of the inserting directions. Accordingly, when the first contact portion and the second contact portion are inserted (press-fitted) and fixed to the first terminal-retaining portion and the second terminal-retaining portion, respectively, the deformation portion is displaced in the direction intersecting the inserting direction, and thereby the contact portion clearance can be adjusted even if at least one of the first contact portion and the second contact portion is positioned improperly with respect to the first terminal-retaining portion or the second terminal-retaining portion, which is caused by the difference between the contact portion clearance and the retaining portion clearance. Thus, with this invention, the first contact portion and the second contact portion can be installed appropriately in the first housing. Note that term "inserting direction" as used herein means the direction in which the terminal is inserted to the first housing (movable housing) during assembly (the upper side in the Z direction) unless otherwise specified.

The deformation portion may be configured to have bent portions that are bent toward the first contact portion and the second contact portion, respectively.

With this invention, the link portion can be elongated compared with a case in which a straight link portion connects the first contact portion and the second contact portion to each other. This enables the link portion to be bent more readily and to be more resistant to breakage due to stress concentration at a joint portion between the link portion and the first contact portion or the second contact portion.

The link portion may be configured to have a first link end that is connected to the first contact portion and a second link end that is connected to the second contact portion, and the first link end is disposed at a position deeper than the second link end in the at least one of the inserting directions.

With the link portion according to this invention, the first link end and the second link end are disposed at different positions in the inserting direction. This can elongate the link portion in the inserting direction compared with a case in which, for example, the first link end and the second link end are positioned side by side with each other in the direction intersecting the inserting direction. This enables the link portion to deform flexibly in the direction intersecting the inserting direction. Moreover, in a case in which a spring contact portion that comes into contact with the connection object is disposed in the second contact portion, the length of a spring in the spring contact portion of the second contact portion can be elongated compared with a case in which the second link end is located at a position deeper than the first link end in the inserting direction or compared with a case in which the second link end is disposed side by side with the first link end in the direction intersecting the inserting direction. This enables the spring contact portion to deform flexibly.

The second contact portion may be configured to have a spring contact portion that comes into contact with the connection object and presses the connection object and also configured to have a second fixation portion that fixes the second contact portion to the second terminal-retaining portion, and the second fixation portion is disposed at a position between the second link end and the spring contact portion.

According to this invention, the second fixation portion that fixes the second contact portion to the second terminal-retaining portion is formed at a position between the second link end and the spring contact portion. Accordingly, the stress generated by displacement or deformation occurring in one of the link portion and the spring contact portion can be prevented from transferring to the other by the second fixation portion that is fixed to the second terminal-retaining portion of the first housing so as not to deform or not to be displaced.

The connector according to the invention may further include a second housing that is different from the first housing. In the connector, the terminal may be configured to have a second housing fixation portion that is fixed to the second housing and a movable portion that displaceably supports the first housing with respect to the second housing. In addition, the first contact portion has a first fixation portion that is fixed to the first terminal-retaining portion, and the first fixation portion is disposed at a position between the first link end and the movable portion.

With this invention, the connector can be formed as a movable structure (i.e., floating structure). The movable structure thereby absorbs the positional difference between the connector and the connection object during engagement and connection, which enables a stable electrical connection. Moreover, according to this invention, the first fixation portion that fixes the first contact portion to the first terminal-retaining portion is formed at a position between the first link end and the movable portion. Accordingly, the stress generated by displacement or deformation occurring in one of the movable portion and the link portion can be prevented from transferring to the other by the first fixation portion that is fixed to the first terminal-retaining portion of the first housing so as not to deform or to be displaced.

In the connector according to the invention, the terminal has a pair of the contact portions that come into contact with the connection object. Even though the connector is structured such that each of the contact portions is fixed independently to the first housing, the deformation of the link portion can adjust the contact portion clearance of the terminal in accordance with the retaining portion clearance of the first housing. Accordingly, the terminal can be installed in the first housing in such a manner that the first contact portion and the second contact portion can be appropriately inserted into, and fixed to, the first and second terminal-retaining portions, respectively. Thus, the connector according to the invention can provide a reliable electrical connection with a connection object.

DESCRIPTION OF THE PREFERRED EMBODIMENTS

A connector according to an embodiment of the invention will be described with reference to the drawings. A connector 1 according to the embodiment described below is a type of connector that is mounted on a circuit board P for electrically connecting a pin terminal T, which is referred to as a "connection object", to the circuit.

Figure 3:
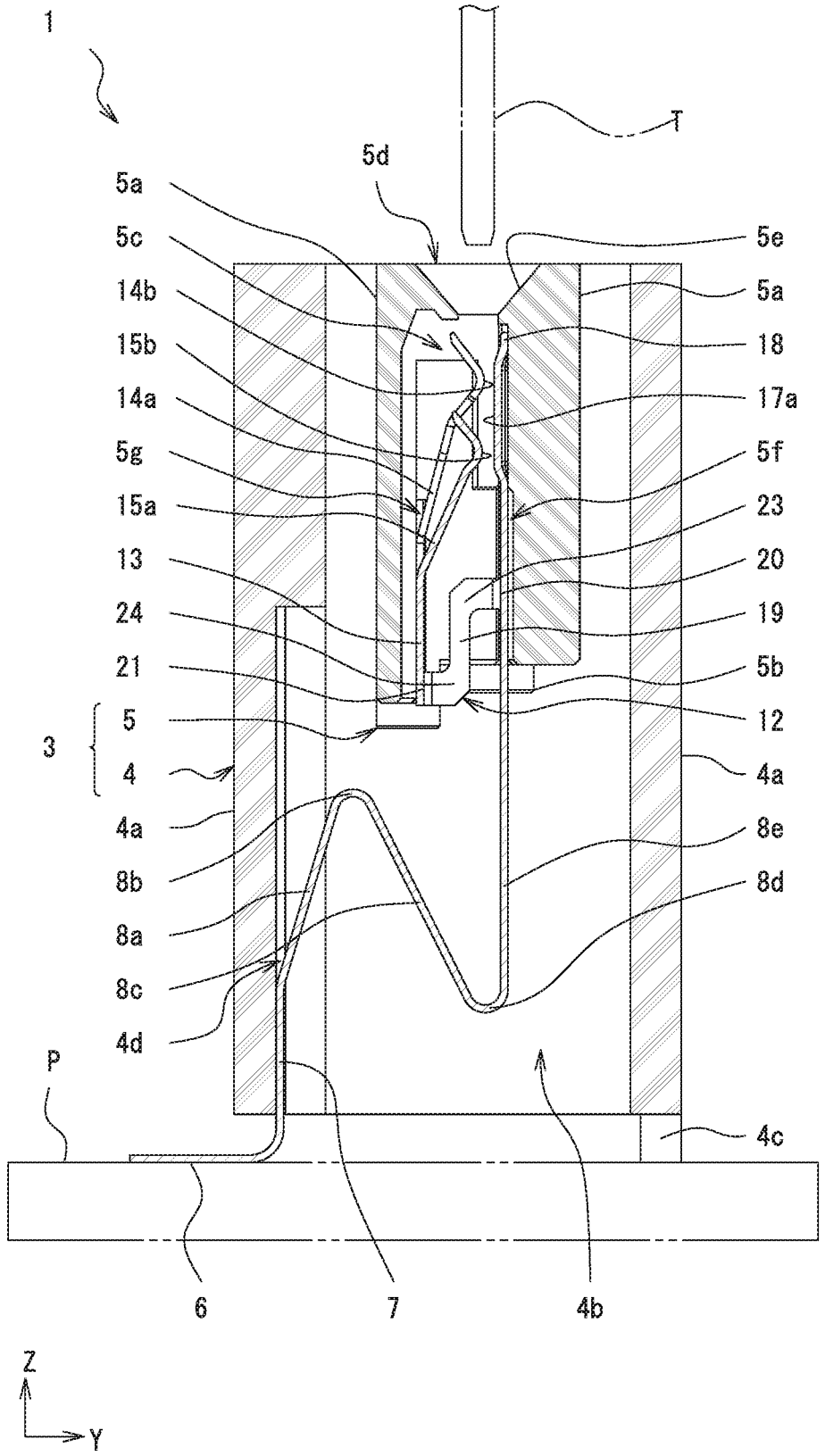
FIG. 3 is a cross section of the connector that is taken along line III-III in FIG. 1.

Terms "first" and "second" as used herein are used solely to distinguish different elements in the invention from each other and not used to imply a specific order nor to imply that one is better than the other. For convenience of description in the present disclosure, the X direction represents the width direction (right-left direction) of the connector 1, the Y direction represents the depth direction (front-rear direction) of the connector 1, and the Z direction represents the height direction (up-down direction) of the connector 1, as illustrated, for example, in FIG. 1. In the description below, with respect to the height direction of the connector 1, a region in which circuit board P (see FIG. 3) is located may be referred to as a lower region, whereas a region in which the connector 1 is located may be referred to as an upper region. However, this is not meant to limit the direction of installing the connector 1 to the circuit board P or any installation manner.

Connector 1

Figure 1:
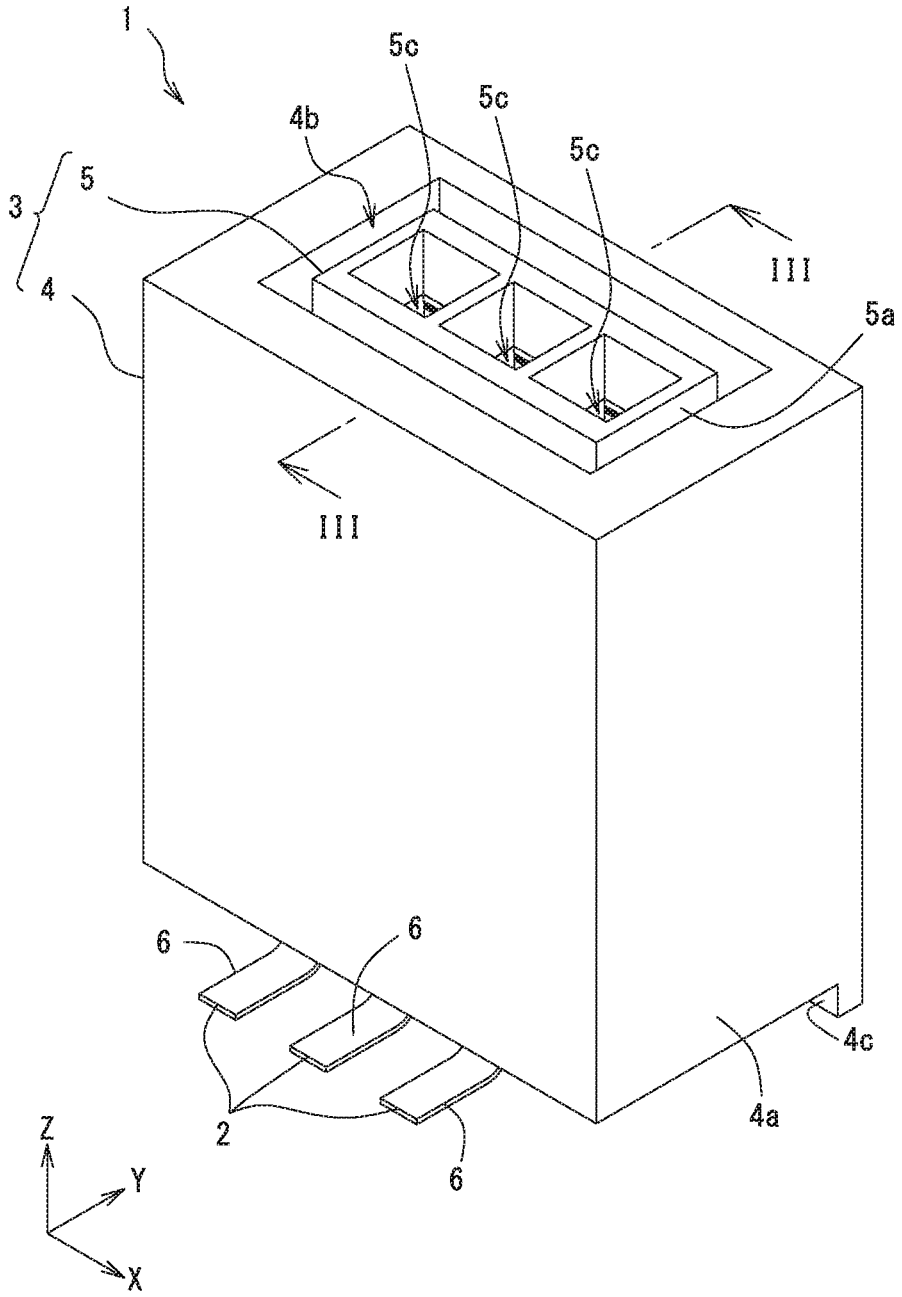
FIG. 1 is a perspective view illustrating the exterior of a connector according to an embodiment, in which the front surface, the right surface, and the top surface of the connector are shown.

As illustrated in FIG. 1, the connector 1 includes a plurality of terminals 2 and a housing 3. The connector 1 is mounted onto the circuit board P (see FIG. 3). Pin terminals T (see FIG. 3) are inserted from the top surface of the housing 3 toward the circuit board P, and the pin terminals T are thereby engaged with, and electrically connected to, the connector 1. Thus, the connector 1 is formed as a so-called "top entry connector".

Housing 3

The housing 3 includes the terminals 2 that are electrically connected to the respective pin terminals T. The housing 3 includes a fixed housing 4, which is referred to as a "second housing", and a movable housing 5, which is referred to as a "first housing".

Fixed Housing 4

The fixed housing 4 is a molded body made of an insulating resin and has a peripheral wall 4*a*. The peripheral wall 4*a* is formed like a quadrangular cylinder and has an accommodation chamber 4*b* therein. The accommodation chamber 4*b* passes through the fixed housing 4 in the height direction Z. The accommodation chamber 4*b* is an accommodation space in which the movable housing 5 is disposed. The fixed housing 4 has legs 4*c* for mounting on the circuit board P. The height of the fixed housing 4 from the circuit board P is adjusted by the legs 4*c*. The legs 4*c* are disposed at the bottom end of the rear side of the peripheral wall 4*a* and at both ends of the rear side in the width direction X. The legs 4*c* protrude downward.

Figure 2:
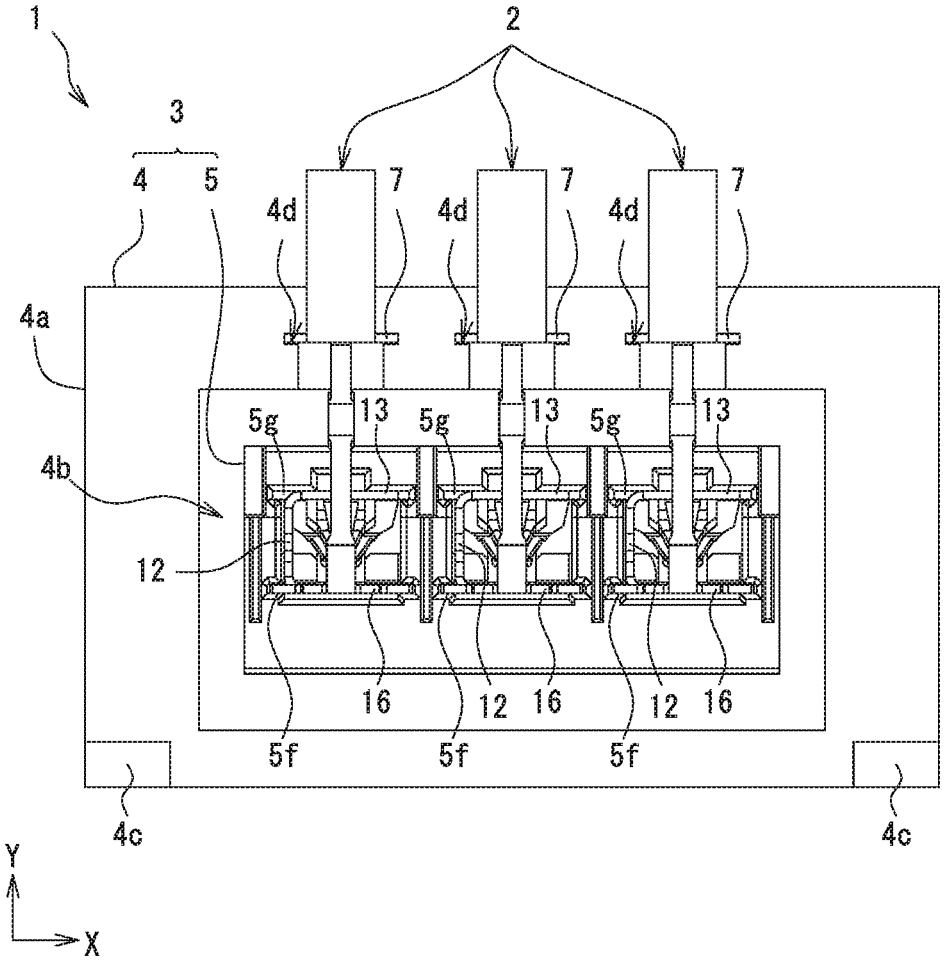
FIG. 2 is a bottom view of the connector of FIG. 1.

As illustrated in FIG. 2, the fixed housing 4 has a plurality of terminal fixation grooves 4*d* to which fixed housing fixation portions 7 of the respective terminals 2 (to be described later) are press-fitted and fixed in a plate width direction. Each of the terminal fixation grooves 4*d* is formed in the height direction Z from the bottom of the peripheral wall 4*a*. Accordingly, each fixed housing fixation portion 7 of the terminal 2 is press-fitted and fixed to the corresponding terminal fixation groove 4*d* from the bottom of the peripheral wall 4*a*.

Movable Housing 5

Figure 4:
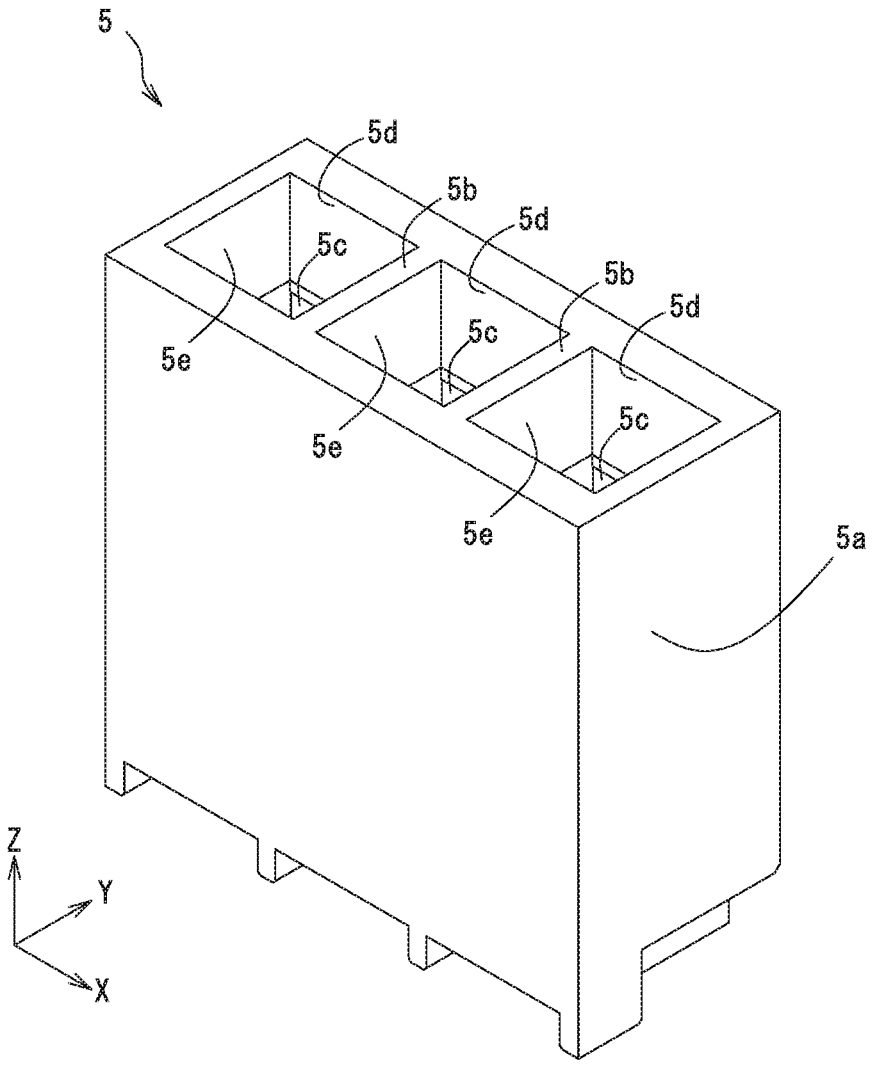
FIG. 4 is a perspective view illustrating the exterior of a movable housing, in which the front surface, the right surface, and the top surface of the movable housing are shown.

As illustrated in FIG. 4, the movable housing 5 is a molded body made of an insulating resin and has a peripheral wall 5*a* and multiple partition walls 5*b*. The peripheral wall 5*a* is formed like a quadrangular cylinder. The peripheral wall 5*a* is formed so as to be smaller than the accommodation chamber 4*b* of the fixed housing 4, and a movement space that extends in the XYZ directions is thereby provided between the peripheral wall 5*a* and the accommodation chamber 4*b*. Thus, the movable housing 5 can be displaced in the XYZ directions within the accommodation chamber 4*b* (see FIGS. 1 to 3). The partition walls 5*b* partition the space inside the peripheral wall 5*a* into multiple spaces in the width direction X. The contact portions 9 of a plurality of the terminals 2 are installed in the movable housing 5, which will be described later, and the partition walls 5*b* function to insulate respective contact portions 9 from each other. Each of the partition walls 5*b* extends, within the peripheral wall 5*a*, in the front-rear direction Y and are connected to the front and the rear sides of the peripheral wall 5*a* in such a manner that the plate thickness direction of each partition wall 5*b* is parallel to the width direction X of the movable housing 5. Each of the partition walls 5*b* extends in the height direction Z from the bottom end to the top end of the movable housing 5. Relatively large partition walls 5*b* extend in the front-rear direction Y and in the height direction Z in the movable housing 5 and partition the internal space of the movable housing 5. This increases the rigidity of the movable housing 5 and enables reliable press-fitting of the contact portions 9 of the terminals 2.

The movable housing 5 has multiple internal spaces each of which is surrounded by the peripheral wall 5*a* and the partition wall 5*b* and passes through the movable housing 5 in the height direction Z. Each of the internal spaces functions as a "retaining portion" that supports the contact portion 9 of each terminal 2 and also functions as a connection chamber 5*c* in which the contact portion 9 and the pin terminal T are electrically connected to each other. The movable housing 5 is provided with insertion openings 5*d* for respective pin terminals T on the top surface thereof. The insertion openings 5*d* are in communication with respective connection chambers 5*c*. A guide slope 5*e* that is shaped like a funnel is formed within each of the insertion openings 5*d*. During engagement and connection of the pin terminal T, the guide slope 5*e* guides the insertion of each pin terminal T and ensures smooth insertion into the connection chamber 5*c* even if the pin terminal T deviates from the center of the insertion opening 5*d* in XY directions.

Figure 5:
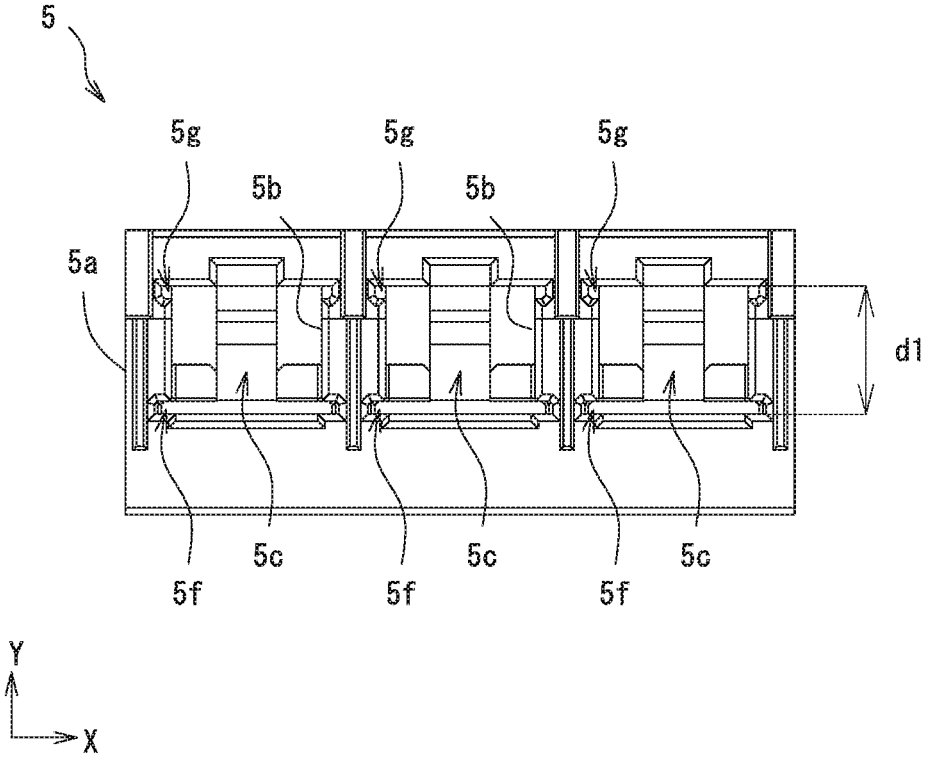
FIG. 5 is a bottom view of the movable housing of FIG. 4.

As illustrated in FIG. 5, each connection chamber 5*c* has a first contact portion fixation groove 5*f*, which is referred to as a "first terminal-retaining portion", and a second contact portion fixation groove 5*g*, which is referred to as a "second terminal-retaining portion". The first contact portion fixation groove 5*f* and the second contact portion fixation groove 5*g* are provided in opposing surfaces that form the connection chamber 5*c*. More specifically, the first contact portion fixation groove 5*f* and the second contact portion fixation groove 5*g* oppose each other in the front-rear direction Y of the movable housing 5. Press-fitted projection 16*a* of a first contact portion 10 (to be described later) of each terminal 2 are press-fitted and fixed to the first contact portion fixation groove 5*f*. Press-fitted projections 13*a* of a second contact portion 11 (to be described later) of each terminal 2 are press-fitted and fixed to the second contact portion fixation groove 5*g*. The contact portion 9 of each terminal 2 is thereby disposed inside the corresponding connection chamber 5*c* in a fixed state.

Inside the connection chamber 5*c*, the surface to which the first contact portion fixation groove 5*f* is provided opposes the surface to which the second contact portion fixation groove 5*g* is provided. The clearance between these opposing surfaces of the connection chamber 5*c* in the front-rear direction Y is set at a retaining portion distance d1 (see FIG. 5), which is referred to as a "retaining portion clearance".

In the present embodiment, three connection chambers 5*c* are provided in a row in the width direction X. However, the number of rows and the number of chambers in a row may be changed arbitrarily in accordance with intended use and specifications.

Terminal 2

Figure 6:
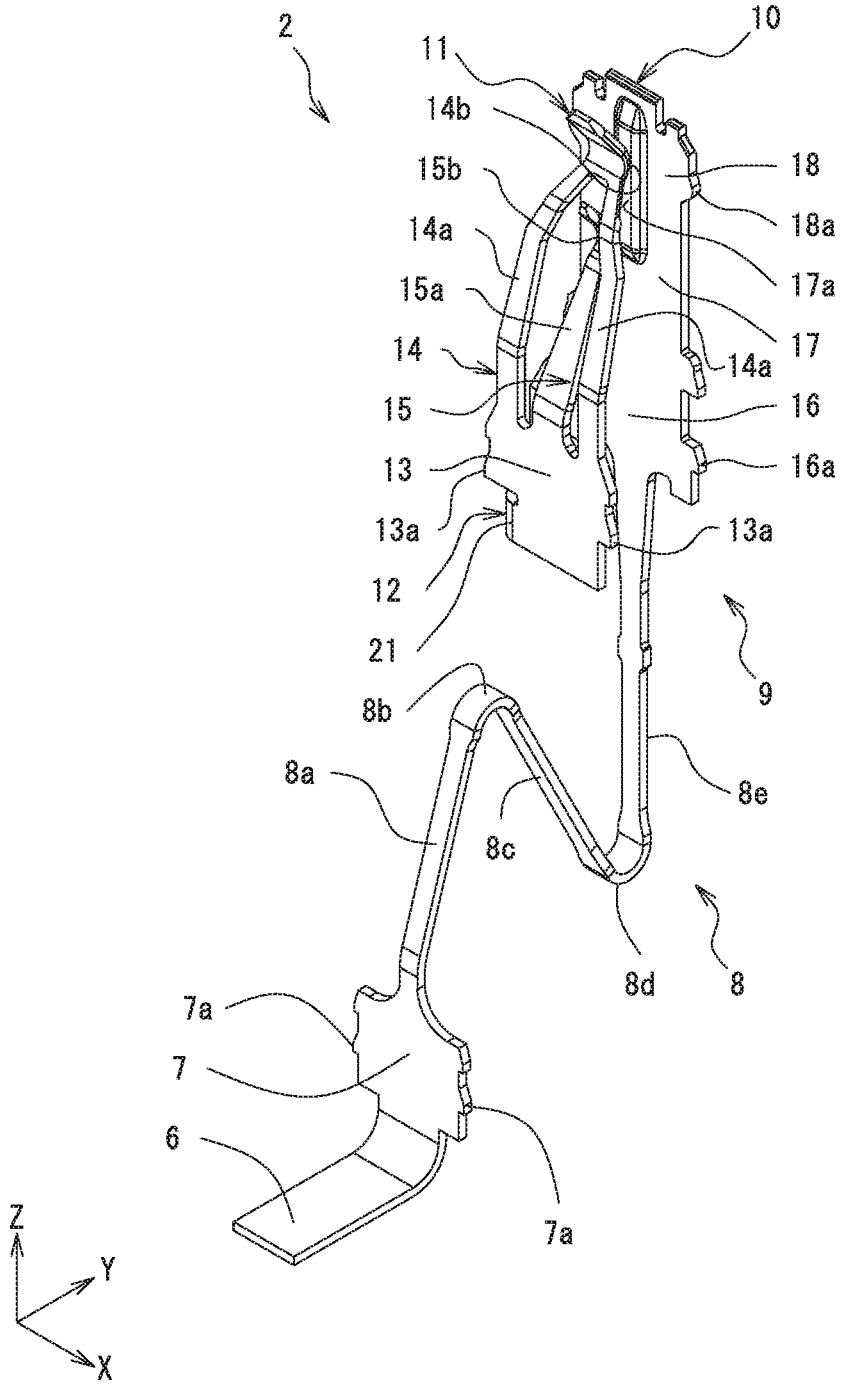
FIG. 6 is a perspective view illustrating the exterior of a terminal, in which the front surface, the right surface, and the top surface of the terminal are shown.

The terminal 2 is an electric conductor made of an electrically conductive metal piece. As illustrated in FIG. 6, the terminal 2 has a circuit board connection portion 6, a fixed housing fixation portion 7 that serves as a "second housing fixation portion", a movable spring portion 8 that serves as a "movable portion", and a contact portion 9. The terminal 2 is a single terminal component having several portions that serve for different functions. The terminal 2 is produced in such a manner that an electrically conductive metal plate material is punched into elongated plate pieces and an elongated plate piece is bent into the single terminal component. The terminal 2 is disposed in the housing 3 in such a manner that the plate width direction of the most part of the terminal 2 is aligned parallel to the width direction (X direction) of the connector 1 and the plate thickness direction of the most part of the terminal 2 is aligned parallel to the depth direction (Y direction) of the connector 1. The connector 1 according to the present embodiment is provided with a plurality of terminals 2, more specifically, provided with three terminals 2. The terminals 2 are arranged in a row in the width direction X of the housing 3 (see FIGS. 1 and 2).

The circuit board connection portion 6 is a portion of each terminal 2 that is located at one end thereof and serves to connect the terminal 2 electrically to the circuit of the circuit board P and also serves to fix the terminal 2 to the circuit board P. One end of the circuit board connection portion 6 protrudes from under the fixed housing 4 toward a region in front thereof in the state in which the terminal 2 is installed in the fixed housing 4 (see FIGS. 1 to 3). Mainly the bottom surface of the circuit board connection portion 6 and the top surface of the circuit board P constitute a soldering portion. The terminal 2 is fixed to the circuit board P via the soldering portion (see FIG. 3).

The fixed housing fixation portion 7 is a portion of the terminal 2 for fixing the terminal 2 to the fixed housing 4. The fixed housing fixation portion 7 is bent and subsequently extends upward in the height direction Z from the rear end of the circuit board connection portion 6, which extends in the front-rear direction Y of the fixed housing 4. The fixed housing fixation portion 7 has press-fitted projections 7*a* formed at respective side edges thereof in the plate width direction (X direction). Each of the press-fitted projections 7*a* protrudes outward from the fixed housing fixation portion 7 in the plate width direction X. These press-fitted projections 7*a* are press-fitted to and engage with the terminal fixation groove 4*d* that is disposed in each accommodation chamber 4*b* of the fixed housing 4, and the terminal 2 is thereby fixed to the fixed housing 4 (see FIG. 2).

Figure 9:
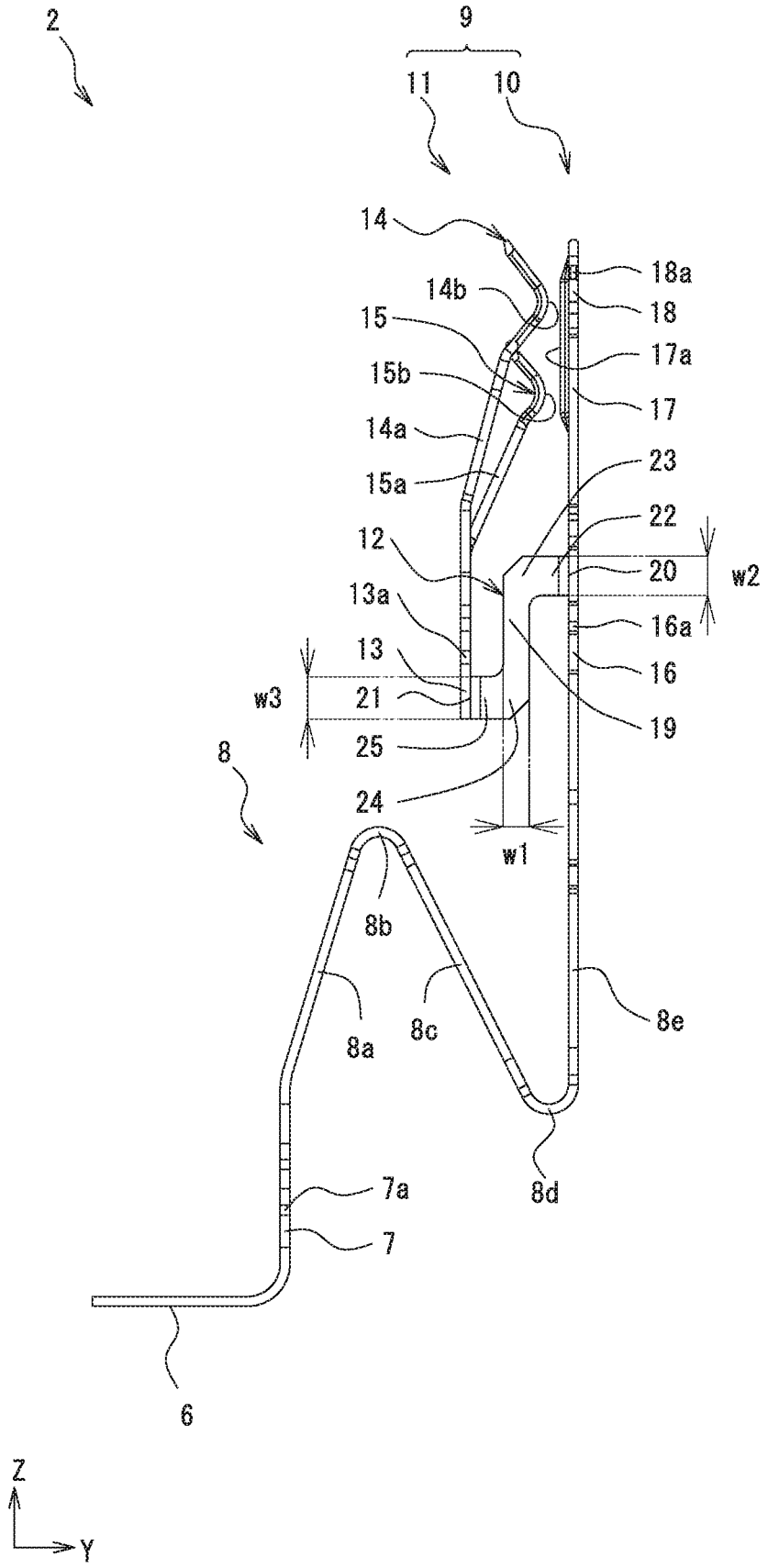
FIG. 9 is a right side view of the terminal of FIG. 6.
Figure 10:
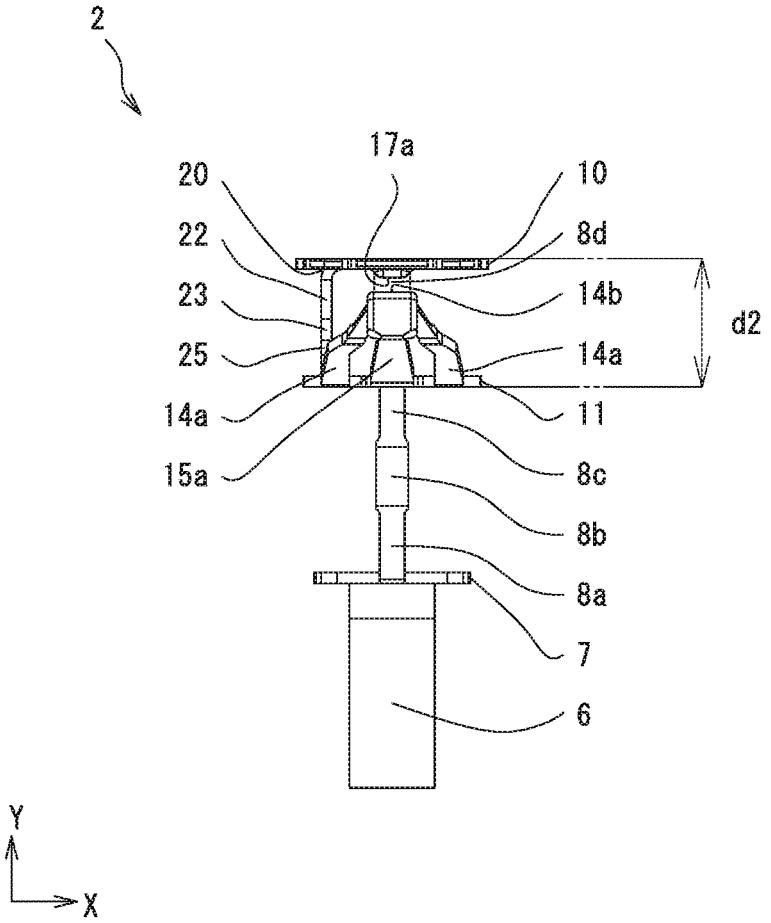
FIG. 10 is a plan view of the terminal of FIG. 6.

The movable spring portion 8 has a floating function. In other words, the movable spring portion 8 supports the movable housing 5 so as to allow the movable housing 5 to be displaced in the three-dimensional directions with respect to the fixed housing 4. As illustrated in FIGS. 6 and 9, the movable spring portion 8 has, in order of closeness to the fixed housing fixation portion 7, a first extension 8*a*, a first fold 8*b*, a second extension 8*c*, a second fold 8*d*, and a third extension 8*e*.

The first extension 8*a* extends diagonally upward from the fixed housing fixation portion 7 in the height direction Z so as to gradually approach the contact portion 9. The first fold 8*b* is an inverted U-shaped portion located at the upper end of the first extension 8*a*. The second extension 8*c* extends downward from the first fold 8*b*. The second fold 8*d* is another inverted U-shaped portion located at the lower end of the second extension 8*c*. The third extension 8*e* extends upward from the second fold 8*d* in the direction parallel to the fixed housing fixation portion 7. In the state in which the terminal 2 is installed in the fixed housing 4, the first fold 8*b* is positioned between the fixed housing fixation portion 7 and the second fold 8*d* in the front-rear direction Y. Accordingly, the first extension 8*a* and the second extension 8*c* incline in the front-rear direction (Y direction) with respect to the vertical direction (Z direction).

The movable spring portion 8 has a narrow plate width compared with other portions of the terminal 2, such as the circuit board connection portion 6, the fixed housing fixation portion 7, and the contact portion 9. In the movable spring portion 8, the widths of the first extension 8*a*, the second extension 8*c*, and the third extension 8*e* are narrower than the widths of the first fold 8*b* and the second fold 8*d*. The first extension 8*a*, the second extension 8*c*, and the third extension 8*e* serve as a spring that can exhibit flexibility. These extensions elastically support the movable housing 5 that is displaced in the three-dimensional directions.

The movable spring portion 8 is formed such that three vertical spring portions, in other words, the first extension 8*a*, the second extension 8*c*, and the third extension 8*e*, extend in the up-down direction and are disposed in a parallel arrangement. This arrangement provides the movable spring portion 8 with a necessary spring length. By disposing the multiple vertical spring portions in the parallel arrangement, the movable spring portion 8 can flexibly support the movable housing 5 when the movable housing 5 is displaced especially in the front-rear direction Y. The durability of the spring can be also improved. The movable spring portion 8 may have more vertical spring portions, for example, five vertical spring portions. This enables the movable spring portion 8 to support the movable housing 5 more flexibly especially when the movable housing 5 is displaced in the front-rear direction Y and also enables further improvement of the durability of the spring.

The contact portion 9 is a portion of the terminal 2 that is accommodated in the connection chamber 5*c* of the movable housing 5 and is electrically connected to a pin terminal T. As illustrated in FIGS. 6 to 10, the contact portion 9 has a first contact portion 10, a second contact portion 11, and a link portion 12 (see FIG. 9). The first contact portion 10 and the second contact portion 11 are flat plates that oppose each other, and the link portion 12 joins the first contact portion 10 and the second contact portion 11 to each other.

The second contact portion 11 has a fixation base portion 13 that serves as a "second fixation portion", a front contact portion 14, and a rear contact portion 15. Both the front contact portion 14 and the rear contact portion 15 serve as a "spring contact portion".

The fixation base portion 13 is a portion for fixing the second contact portion 11 to the movable housing 5. The fixation base portion 13 is shaped as a flat portion and extends in the up-down direction Z. Press-fitted projections 13*a* are formed at respective side edges of the fixation base portion 13 in the plate width direction (X direction). Each of the press-fitted projections 13*a* protrudes outward from the fixation base portion 13 in the plate width direction X. These press-fitted projections 13*a* of the fixation base portion 13 are press-fitted to and engage with the second contact portion fixation groove 5*g* that is disposed in the connection chamber 5*c* of the movable housing 5, and the second contact portion 11 is thereby fixed to the movable housing 5 (see FIG. 2).

It is sufficient to form the fixation base portion 13 so as to be able to fix the second contact portion 11 to the movable housing 5. Accordingly, for example, the connector 1 may be formed such that the fixation base portion 13 has a groove and the groove engages a press-fitted projection that is provided in the movable housing 5. Moreover, the protruding direction of the press-fitted projection 13*a* may be parallel to the plate thickness direction. To match this invention, a groove recessed in the front-rear direction may be provided in the connection chamber 5*c* of the movable housing 5.

In the present embodiment, the fixation base portion 13 is provided at a position between the link portion 12 and the front and rear contact portions 14 and 15 and is firmly fixed to the movable housing 5 by press-fitting. The fixation base portion 13 does not deform and is not displaced easily. If the link portion 12 is displaced or deforms, it is not likely that the stress resulted therefrom is transferred beyond the fixation base portion 13 toward the front and rear contact portions 14 and 15. The stress transfer is prevented by the fixation base portion 13. On the other hand, if the front contact portion 14 or the rear contact portion 15 is displaced, the stress is not transferred beyond the fixation base portion 13 toward the link portion 12. The stress transfer is prevented by the fixation base portion 13. Thus, the displacement of the link portion 12 and the displacement of the front contact portion 14 or the rear contact portion 15 can independently be displaced and do not mechanically affect each other due to the fixation base portion 13 being firmly fixed to the movable housing 5 by the press-fitted projections 13*a*. The stress generated in each portion does not causes the deformation of other portions. Thus, the connector 1 can achieve a stable electrical connection with pin terminals T.

The front contact portion 14 has two front elastic arms 14*a* and a front contact point 14*b*. The two front elastic arms 14*a* are portions located near corresponding side edges of the front contact portion 14 in the plate width direction X. The two front elastic arms 14*a* extend upward from the fixation base portion 13 in the up-down direction Z so as to be parallel to each other. The two front elastic arms 14*a* are bent toward the center in the plate width direction X at a position near the ends of the two front elastic arms 14*a* and are joined to each other to form a joint portion. The front elastic arms 14*a* are formed so as to approach the first contact portion 10 in the front-rear direction Y as the distance from the fixation base portion 13 become larger (see FIG. 9).

Figure 7:
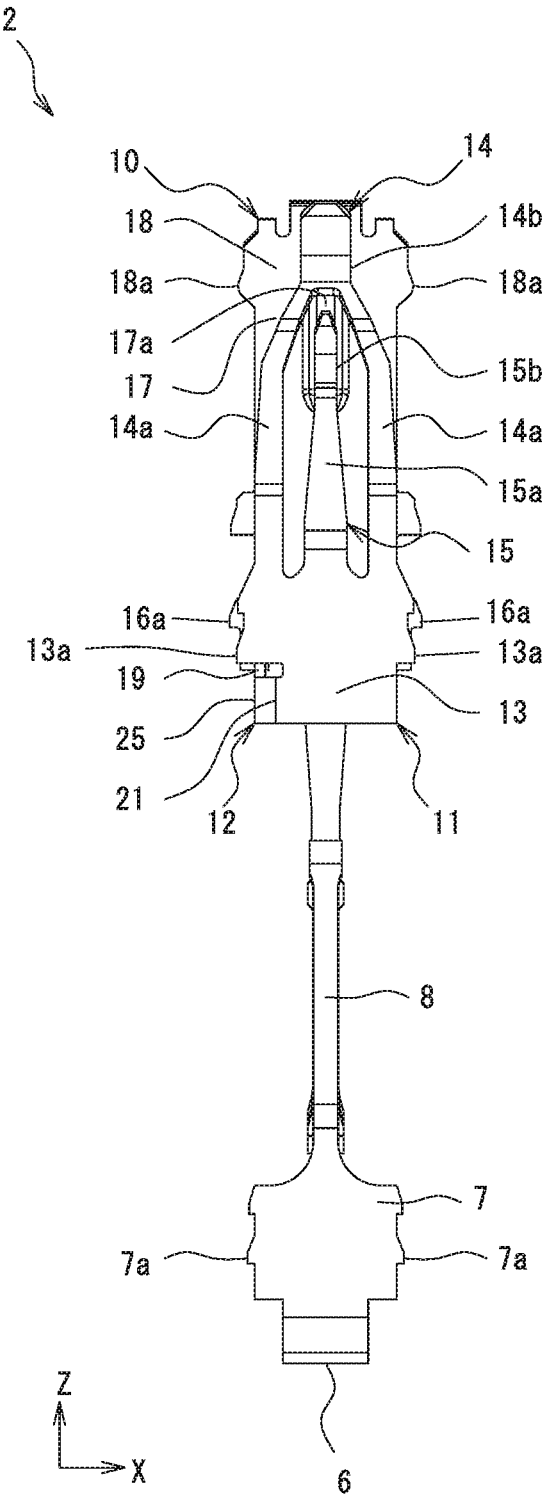
FIG. 7 is a front view of the terminal of FIG. 6.

The front contact point 14*b* extends further upward from the joint portion at which the end portions of the two front elastic arms 14*a* are joined to each other (see FIG. 7). The front contact point 14*b* is formed so as to protrude in a convex manner with the peak approaching the first contact portion 10 (see FIG. 9). The front contact point 14*b* is displaceably supported by the front elastic arms 14*a* and is formed so as to press the pin terminal T (connection object) rearward in the front-rear direction Y.

The rear contact portion 15 also functions to press the pin terminal T rearward in the front-rear direction Y. The rear contact portion 15 is formed so as to extend upward from the fixation base portion 13 as is the case for the front contact portion 14. In other words, the rear contact portion 15 has a rear elastic arm 15*a* that is disposed at a position between the two front elastic arms 14*a* in the plate width direction X. The rear contact portion 15 also has a rear contact point 15*b* that is shaped like a convexity and is displaceably supported by the rear elastic arm 15*a*. The front elastic arms 14*a* are joined to each other at a position above the end of the rear contact portion 15. Accordingly, the rear contact portion 15 is positioned, in the front view, inside a region surrounded by the fixation base portion 13 and the two front elastic arms 14*a* (see FIG. 7). In addition, the rear contact portion 15 is positioned, in a side view, inside a region between the first contact portion 10 and the front contact portion 14 (see FIG. 9).

The second contact portion 11 is formed such that the front contact portion 14 and the rear contact portion 15 extend in parallel with each other from the common fixation base portion 13 so as to serve as spring portions. With this invention of the second contact portion 11, the rear elastic arm 15*a* can be formed easily into an elongated arm. Thus, both of the front elastic arms 14*a* and the rear elastic arm 15*a* can be flexibly displaced so as to follow the rotation of the pin terminal T. The front contact point 14*b* and the rear contact point 15*b* can thereby maintain a favorable connection condition with the pin terminal T. Moreover, both of the front contact point 14*b* and the rear contact point 15*b* have roll surfaces (which are bent surfaces, rather than cut surfaces, that are made of electrically conductive metal pieces). Thus, the front contact point 14*b* and the rear contact point 15*b* exhibit less resistance against insertion of the pin terminal T and thereby the durability to withstand insertion/extraction of the pin terminal T can be improved.

The first contact portion 10 has a base-side fixation portion 16 that serves as a "first fixation portion" and a contact receptacle portion 17. The first contact portion 10 extends upward from the third extension 8*e* of the movable spring portion 8.

The base-side fixation portion 16 is a portion for fixing the first contact portion 10 to the movable housing 5. The base-side fixation portion 16 is shaped as a flat portion and extends in the up-down direction Z. Press-fitted projections 16*a* are formed at respective side edges of the base-side fixation portion 16 in the plate width direction (X direction). Each of the press-fitted projections 16*a* protrudes outward from the base-side fixation portion 16 in the plate width direction X. These press-fitted projections 16*a* of the base-side fixation portion 16 are press-fitted to and engage with the first contact portion fixation groove 5*f* that is provided in the connection chamber 5*c* of the movable housing 5, and the first contact portion 10 is thereby fixed to the movable housing 5 (see FIG. 2). The contact receptacle portion 17 is thereby firmly fixed to the movable housing 5 independently of other part of the contact portion 9 and comes into contact with the pin terminal T along its longitudinal surface. The contact receptacle portion 17 can thereby receive the pin terminal T that are pressed by the front contact portion 14 and the rear contact portion 15.

It is sufficient to form the base-side fixation portion 16 so as to be able to fix the first contact portion 10 to the movable housing 5 as is the case for the fixation base portion 13. Accordingly, for example, the connector 1 may be formed such that the base-side fixation portion 16 has a groove and the groove engages a press-fitted projection that is provided in the movable housing 5. Moreover, the protruding direction of the press-fitted projection 16*a* may be parallel to the plate thickness direction. To match this invention, a groove recessed in the front-rear direction may be provided in the connection chamber 5*c* of the movable housing 5.

In the present embodiment, the base-side fixation portion 16 is provided at a position between the link portion 12 and the movable spring portion 8 and is firmly fixed to the movable housing 5 by press-fitted. Thus, the base-side fixation portion 16 does not deform and is not displaced easily. Even if the movable spring portion 8 is displaced or deforms, it is not likely that the stress resulted therefrom is transferred to the link portion 12 beyond the base-side fixation portion 16. On the other hand, even if the link portion 12 deforms, the stress is not transferred to the movable spring portion 8 beyond the base-side fixation portion 16. The stress transfer is prevented by the base-side fixation portion 16. The stress generated in each portion does not cause the deformation of other portions. Thus, the connector 1 can achieve a stable electrical connection with pin terminals T.

The contact receptacle portion 17 extends from the base-side fixation portion 16 so as to form a cantilever. The contact receptacle portion 17 opposes the second contact portion 11 and is formed as a flat plate. The contact receptacle portion 17 has a contact face 17*a* disposed on a surface opposing the front contact portion 14 and the rear contact portion 15. The contact face 17*a* is formed such that a projection that is raised toward the front contact portion 14 and the rear contact portion 15 extends in the inserting direction of the pin terminal T (in the Z direction). The contact face 17*a* is shaped like an elongated bead. The contact face 17*a* is a portion that comes into contact with the pin terminal T. Accordingly, the contact face 17*a* is formed to be longer than at least the distance between the front contact point 14*b* and the rear contact point 15*b*.

The contact receptacle portion 17 may be formed as a projected surface that is raised one step toward the front contact point 14*b* and the rear contact point 15*b* with respect to the base-side fixation portion 16. This makes it easier for the front contact point 14*b* and the rear contact point 15*b* to maintain constant contact pressures irrespective of the degree of insertion of the pin terminal T. Moreover, the contact receptacle portion 17 may have a contact face 17*a* that is formed into a flat surface rather than the projection as an elongated bead. The contact receptacle portion 17 having the flat contact face 17*a* can be formed easily.

Figure 8:
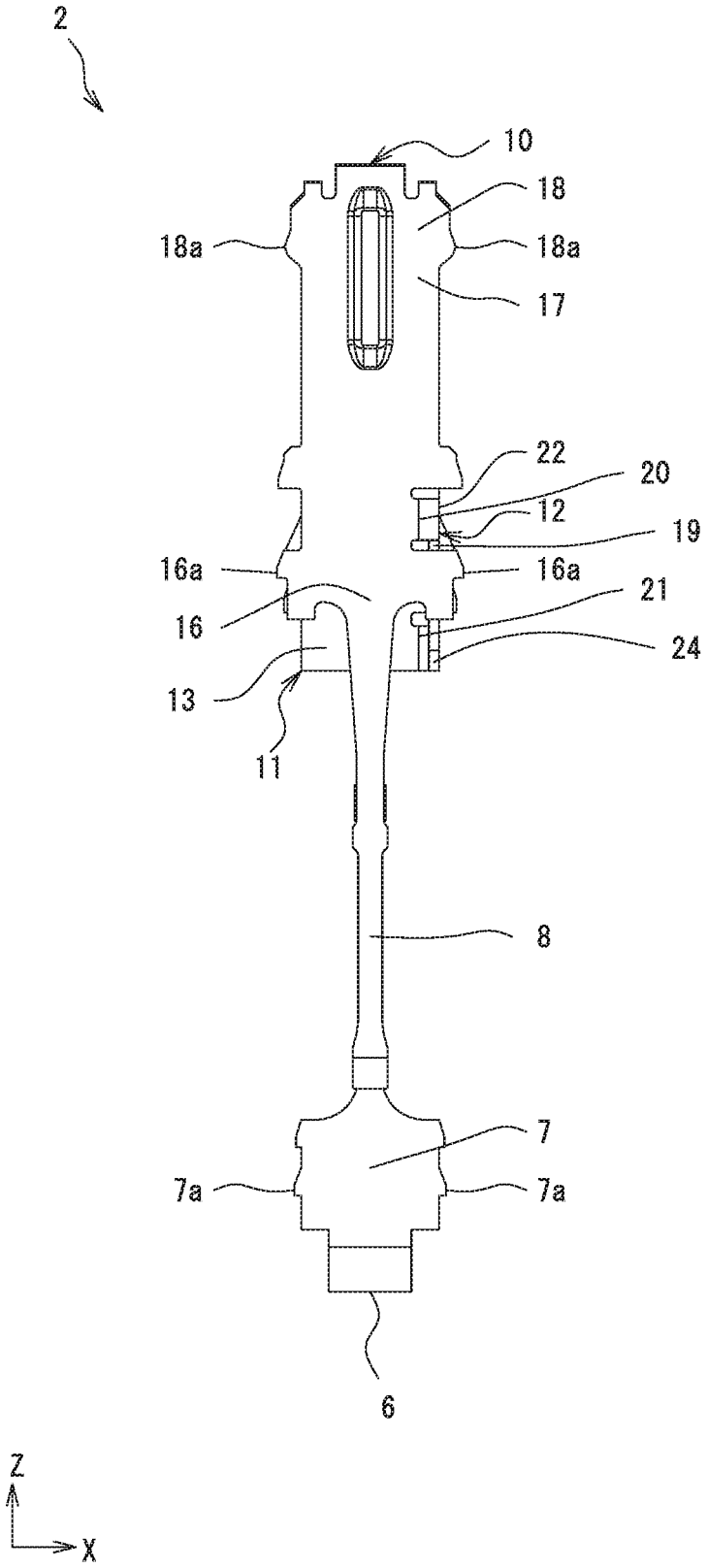
FIG. 8 is a rear view of the terminal of FIG. 6.

As illustrated in FIGS. 6 to 8, the first contact portion 10 has an end-side fixation portion 18 disposed at an upper end portion (end side) thereof in the up-down direction. The end-side fixation portion 18 is fixed to the movable housing 5. Press-fitted projections 18*a* are formed at respective side edges of the end-side fixation portion 18 in the plate width direction (X direction), as is the case for the press-fitted projection 16*a* of the base-side fixation portion 16. Each of the press-fitted projections 18*a* protrudes outward from the end-side fixation portion 18 in the plate width direction X. The end-side fixation portion 18 can firmly fix the first contact portion 10 to the connection chamber 5*c* so as not to protrude toward the interior space of the connection chamber 5*c*. If the press-fitted projection 18*a* is formed, for example, so as to project in the height direction Z from the end of the end-side fixation portion 18, the first contact portion 10 may become large in the height direction Z and accordingly the connector 1 may become large in the height direction Z. In the present embodiment, however, the press-fitted projections 18*a* are formed so as to project outward from the respective side edges of the end-side fixation portion 18 in the plate width direction X. With this invention, the sizes of the terminal 2 and the connector 1 can be reduced in the height direction Z.

The link portion 12, which is formed as an elastic and deformable portion, connects the first contact portion 10 and the second contact portion 11 to each other. The link portion 12 deforms when the terminal 2 is installed in the movable housing 5 and thereby functions to change the clearance (contact portion clearance) between the first contact portion 10 and the second contact portion 11 in the opposing direction Y (clearance direction Y).

Here, the clearance (contact portion clearance) between the first contact portion 10 and the second contact portion 11 in the opposing direction Y means the distance in the front-rear direction Y between the rear surface of the first contact portion 10 at the base-side fixation portion 16 and the front surface of the second contact portion 11 at the fixation base portion 13. In the present embodiment, this distance is referred to as a "contact portion distance d2" (see FIG. 10). In addition, "to change the clearance in the opposing direction" means that the clearance (contact portion distance d2) between the first contact portion 10 and the second contact portion 11 is changed such that the clearance becomes larger or smaller with respect to either one of the first contact portion 10 or the second contact portion 11. Here, it is desirable that the link portion 12 deform without changing the relative angle between the first contact portion 10 and the second contact portion 11. For example, in the case in which the first contact portion 10 is parallel to the second contact portion 11 before installation, it is desirable that the contact portion distance d2 between the first contact portion 10 and the second contact portion 11 change with the parallel condition maintained.

As described above, the link portion 12 can change the contact portion distance d2 due to the link portion 12 enabling parallel displacement of the first contact portion 10 and the second contact portion 11 without changing the relative angle therebetween. The clearance between the first contact portion fixation groove 5*f* and the second contact portion fixation groove 5*g* (retaining portion distance d1) in the connection chamber 5*c* may vary within tolerance limits. In addition, the clearance between the first contact portion 10 (base-side fixation portion 16) and the second contact portion 11 (fixation base portion 13) (contact portion distance d2) may also vary within tolerance limits. Even in the case of such variation within tolerance limits, the link portion 12 deforms appropriately and the first contact portion 10 and the second contact portion 11 can be thereby press-fitted and fixed to the first contact portion fixation groove 5*f* and the second contact portion fixation groove 5*g*, respectively. Thus, the clearance between the first contact portion 10 and the second contact portion 11 is adjusted appropriately within the connection chamber 5*c*, which thereby enables a stable electrical connection with the pin terminal T.

As described above, the link portion 12 deforms when the first contact portion 10 and the second contact portion 11 are inserted into the first contact portion fixation groove 5*f* and the second contact portion fixation groove 5*g*, respectively. The deformation of the link portion 12 absorbs the dimensional variation (difference between the retaining portion distance d1 and the contact portion distance d2). However, after the first contact portion 10 and the second contact portion 11 are fixed to the first contact portion fixation groove 5*f* and the second contact portion fixation groove 5*g*, the link portion 12 may stay in a deformed state. Accordingly, the displacement and deformation of the link portion 12 is not limited to elastic deformation but may include plastic deformation. Note that if the deformation of the link portion 12 stays within an elastic deformation region, ruptures or cracks do not tend to occur and the load to which terminal 2 is subjected can be reduced.

The link portion 12 can be configured to have, for example, an elastic deformation portion 19, which is referred to as a "deformation portion". As illustrated in FIG. 9, the elastic deformation portion 19 extends in the inserting direction (i.e., the up-down direction) in which the first contact portion 10 and the second contact portion 11 are inserted into the connection chamber 5*c*. The link portion 12 also has a first link end 20 and a second link end 21. The first link end 20 is joined to one side edge (left edge) of the first contact portion 10, and the second link end 21 is joined to one side edge (left edge) of the second contact portion 11. The elastic deformation portion 19 is formed so as to be able to deform in the opposing direction Y in which the first contact portion 10 and the second contact portion 11 oppose each other. More specifically, for example, if the clearance between the first contact portion 10 and the second contact portion 11 is smaller than the clearance between the first contact portion fixation groove 5*f* and the second contact portion fixation groove 5*g*, the first link end 20 of the link portion 12 is displaced away from the second contact portion 11 and the second link end 21 of the link portion 12 is displaced away from the first contact portion 10 so as to increase the contact portion distance d2 between the first contact portion 10 and the second contact portion 11. As a result, the link portion 12 is subjected to bending deformation in such a manner that the elastic deformation portion 19 rotates clockwise in FIG. 9 and inclines obliquely with respect to the inserting direction Z. On the other hand, if the clearance between the first contact portion 10 and the second contact portion 11 is larger than the clearance between the first contact portion fixation groove 5*f* and the second contact portion fixation groove 5*g*, the link portion 12 deforms so as to decrease the contact portion distance d2 between the first contact portion 10 and the second contact portion 11. In other words, the first link end 20 is displaced toward the second contact portion 11, and the second link end 21 is displaced toward the first contact portion 10. As a result, the link portion 12 is subjected to bending deformation in such a manner that the elastic deformation portion 19 rotates counterclockwise in FIG. 9 and inclines obliquely with respect to the inserting direction Z.

As described above, when the first contact portion 10 and the second contact portion 11 are inserted (press-fitted) and fixed to the first terminal-retaining portion and the second terminal-retaining portion, respectively, the terminal 2 is installed such that at least one of the first contact portion 10 and the second contact portion 11 of the terminal 2 may deviate from the first contact portion fixation groove 5*f* or the second contact portion fixation groove 5*g*, which is caused by the difference between the retaining portion clearance d1 and the contact portion clearance d2. Even in this case, the elastic deformation portion 19 deforms, and thereby the terminal 2 can adjust the contact portion distance d2 to the retaining portion distance d1. Thus, the first contact portion 10 and the second contact portion 11 can be installed appropriately in the movable housing 5.

Note that the elastic deformation portion 19 is positioned between the first contact portion 10 and the second contact portion 11. Accordingly, the space between the first contact portion 10 and the second contact portion 11 is provided effectively for the deformation of the elastic deformation portion 19.

As illustrated in FIG. 9, the first link end 20 is disposed at a position deeper than the second link end 21 in the inserting direction Z in which the terminal 2 is inserted into the movable housing 5 during assembly. In other words, in the link portion 12, the first link end 20 and the second link end 21 are disposed at different positions in the inserting direction Z. This can elongate the link portion 12 in the inserting direction Z compared with a case in which, for example, the first link end 20 and the second link end 21 are disposed side by side with each other in the intersecting direction Y of the inserting direction Z. This enables the elastic deformation portion 19 to deform easily, and thereby the terminal 2 can change the clearance between the first contact portion 10 and the second contact portion 11.

Moreover, with the link portion 12 according to the present embodiment, the length of each spring in the front and rear contact portions 14 and 15 of the second contact portion 11 can be elongated compared with a case in which the second link end 21 is disposed at a position deeper than the first link end 20 in the inserting direction Z or compared with the case in which the second link end 21 is disposed side by side with the first link end 20 in the intersecting direction Y intersecting the inserting direction Z. Thus, the terminal 2 can disperse the stress acting in the second contact portion 11 and thereby make the second contact portion 11 more resistant to breakage.

The elastic deformation portion 19 is joined to the first contact portion 10 and the second contact portion 11 via bent portions. The bent portions are bent from the elastic deformation portion 19 (i.e., from the inserting direction) and extend in respective directions toward the first contact portion 10 and the second contact portion 11. In other words, as illustrated in FIG. 9, the link portion 12 has, in order from the first contact portion 10 to the second contact portion 11, a first link arm portion 22, a first bent portion 23 serving as the "bent portion", the elastic deformation portion 19, a second bent portion 24 also serving as the "bent portion", and a second link arm portion 25. The first link arm portion 22 extends from the first link end 20 at the first contact portion 10 to the first bent portion 23. The first bent portion 23 is connected between the first link arm portion 22 and the elastic deformation portion 19. The second bent portion 24 is connected between the elastic deformation portion 19 and the second link arm portion 25. The second link arm portion 25 extends from the second bent portion 24 to the second link end 21 at the second contact portion 11.

Thus, the first contact portion 10 is connected to the second contact portion 11 via the first bent portion 23 and the second bent portion 24. This enables the terminal 2 to have an elongated link portion 12 compared with a case in which the first contact portion 10 and the second contact portion 11 are connected by a straight link portion. As a result, the link portion 12 can be bent easily, and thereby the terminal 2 can change the clearance between the first contact portion 10 and the second contact portion 11 in the opposing direction Y more easily.

In addition, with this invention, when the elastic deformation portion 19 deforms, the stress concentration on the end of the linkage, in other words, the stress concentration on at least one of the first link end 20 and the second link end 21, can be suppressed compared with the case in which a straight link portion connects the elastic deformation portion 19 to the first contact portion 10 and to the second contact portion 11. Thus, breakage at end portions of the terminal 2 can be suppressed.

Here, let w1 denote the width of the elastic deformation portion 19 that is the length in the front-rear direction, w2 denote the width of the first link arm portion 22 that is the length in the up-down direction, and w3 denote the width of the second link arm portion 25 that is the length in the up-down direction. As illustrated in FIG. 9, width w1 of the elastic deformation portion 19 is narrower than width w2 of the first link arm portion 22 and width w3 of the second link arm portion 25. With this invention, the elastic deformation portion 19 can elastically deform more easily than the first link arm portion 22 and the second link arm portion 25. This enables the link portion 12 to change the clearance between the first contact portion 10 and the second contact portion 11 in the opposing direction Y more easily. Moreover, the first link arm portion 22 and the second link arm portion 25 become more resistant to deformation or buckling in a case of receiving an external force from the first contact portion 10 or the second contact portion 11.

Note that as illustrated in FIG. 8, side edge portions of the base-side fixation portion 16 are formed at the upper and lower sides of the first link end 20, respectively. On the other hand, as illustrated in FIG. 7, a side edge portion of the fixation base portion 13 is formed only at the upper side of the second link end 21 and no side edge portion is formed at the lower side thereof. When the link portion 12 receives a load, the second link arm portion 25 tends to deform more easily than the first link arm portion 22 of which both upper and lower side are fixed to the base-side fixation portion 16. Accordingly, the first link arm portion 22 is formed so as to be longer than the second link arm portion 25 in the front-rear direction Y, and width w2 of the first link arm portion 22 is made narrower than width w3 of the second link arm portion 25. This enables the first link arm portion 22 and the second link arm portion 25 to bend similarly and to suppress unbalanced deformation.

Modification Example

In the link portion 12 according to the present embodiment, one end of the elastic deformation portion 19 is connected to the first contact portion 10 via the first link arm portion 22 and the first bent portion 23, while the other end of the elastic deformation portion 19 is connected to the second contact portion 11 via the second link arm portion 25 and the second bent portion 24. In contrast, the link portion 12 may be formed into a Z-shape in such a manner that one end of a straight elastic deformation portion 19 is directly connected to the first contact portion 10 and the other end thereof is directly connected to the second contact portion 11.

In the present embodiment, as illustrated in FIG. 9, the elastic deformation portion 19 extends in the inserting direction Z. However, the elastic deformation portion 19 may be formed so as to extend obliquely with respect to the inserting direction Z. For example, the elastic deformation portion 19 may be disposed obliquely with respect to the inserting direction Z in such a manner that the elastic deformation portion 19 is rotated clockwise in FIG. 9 in advance. The first link arm portion 22 and the second link arm portion 25 can be thereby made shorter compared with that illustrated in FIG. 9. Alternatively, the elastic deformation portion 19 may be disposed obliquely with respect to the inserting direction Z in such a manner that the elastic deformation portion 19 is rotated counterclockwise in FIG. 9 in advance. The first link arm portion 22 and the second link arm portion 25 can be thereby made longer compared with that illustrated in FIG. 9.

The elastic deformation portion 19 is elongated in the inserting direction Z. The elastic deformation portion 19 thereby deforms so as to change the clearance (contact portion distance d2) between the first contact portion 10 and the second contact portion 11. Accordingly, the elastic deformation portion 19 may be formed, for example, into a U-shape. In this case, for example, one end of the U-shape is connected to the first contact portion 10 via the first link arm portion 22 and the first bent portion 23 and the other end of the U-shape is connected to the second contact portion 11 via the second link arm portion 25 and the second bent portion 24. Moreover, the elastic deformation portion 19 may be formed into a square wave U-shape. In this case, for example, one end of the square wave U-shape is connected to the first contact portion 10 via the first link arm portion 22 and the first bent portion 23 and the other end of the square wave U-shape is connected to the second contact portion 11 via the second link arm portion 25 and the second bent portion 24.

What is claimed is:

1. A connector comprising:

a terminal that has a first contact portion and a second contact portion disposed so as to be separated from the first contact portion and is electrically connected to a connection object to be inserted to a position between the first contact portion and the second contact portion; and a first housing that has a first terminal-retaining portion that retains the first contact portion and a second terminal-retaining portion that retains the second contact portion, wherein the terminal has a link portion that joins the first contact portion and the second contact portion to each other and that deforms so as to change a contact portion clearance between the first contact portion and the second contact portion in accordance with a retaining portion clearance between the first terminal-retaining portion and the second terminal-retaining portion, and wherein the link portion has a first link arm portion that extends from the first contact portion in a direction different from an insertion direction of the connection object and a second link arm portion that extends from the second contact portion in a direction different from an insertion direction of the connection object and a deformation portion that has one end connected to the first link arm portion and another end connected to the second link arm portion, and at least one part of the deformation portion extends in the insertion direction of the connection object.

2. The connector according to claim 1, wherein the deformation portion has bent portions that are bent toward the first contact portion and the second contact portion, respectively.

3. The connector according to claim 1, wherein the link portion has a first link end that is connected to the first contact portion and that is connected to one end of the first link arm portion, and a second link end that is connected to the second contact portion and that is connected to one end of the second link arm portion, and the first link end is disposed at a position deeper than the second link end in the at least one of the inserting directions.

4. The connector according to claim 3, further comprising a second housing that is different from the first housing, wherein the terminal has a second housing fixation portion that is fixed to the second housing and a movable portion that displaceably supports the first housing with respect to the second housing, the first contact portion has a first fixation portion that is fixed to the first terminal-retaining portion, and the first fixation portion is disposed at a position between the first link end and the movable portion.

5. The connector according to claim 2, wherein the link portion has a first link end that is connected to the first contact portion and that is connected to one end of the first link arm portion, and a second link end that is connected to the second contact portion and that is connected to one end of the second link arm portion, and the first link end is disposed at a position deeper than the second link end in the at least one of the inserting directions.

6. The connector according to claim 5, further comprising a second housing that is different from the first housing, wherein the terminal has a second housing fixation portion that is fixed to the second housing and a movable portion that displaceably supports the first housing with respect to the second housing, the first contact portion has a first fixation portion that is fixed to the first terminal-retaining portion, and the first fixation portion is disposed at a position between the first link end and the movable portion.

7. The connector according to claim 3, wherein the second contact portion has a spring contact portion that comes into contact with the connection object and presses the connection object and a second fixation portion that fixes the second contact portion to the second terminal-retaining portion, and the second fixation portion is disposed at a position between the second link end and the spring contact portion.

8. The connector according to claim 7, further comprising a second housing that is different from the first housing, wherein the terminal has a second housing fixation portion that is fixed to the second housing and a movable portion that displaceably supports the first housing with respect to the second housing, the first contact portion has a first fixation portion that is fixed to the first terminal-retaining portion, and the first fixation portion is disposed at a position between the first link end and the movable portion.

9. The connector according to claim 5, wherein the second contact portion has a spring contact portion that comes into contact with the connection object and presses the connection object and a second fixation portion that fixes the second contact portion to the second terminal-retaining portion, and the second fixation portion is disposed at a position between the second link end and the spring contact portion.

10. The connector according to claim 9, further comprising a second housing that is different from the first housing, wherein the terminal has a second housing fixation portion that is fixed to the second housing and a movable portion that displaceably supports the first housing with respect to the second housing, the first contact portion has a first fixation portion that is fixed to the first terminal-retaining portion, and the first fixation portion is disposed at a position between the first link end and the movable portion.

11. A connector comprising:

a terminal that has a first contact portion and a second contact portion disposed so as to be separated from the first contact portion and is electrically connected to a connection object to be inserted to a position between the first contact portion and the second contact portion; and a first housing that has a first terminal-retaining portion that retains the first contact portion and a second terminal-retaining portion that retains the second contact portion, wherein the terminal has a link portion that joins the first contact portion and the second contact portion to each other and that deforms so as to change a contact portion clearance between the first contact portion and the second contact portion in accordance with a retaining portion clearance between the first terminal-retaining portion and the second terminal-retaining portion, and wherein the link portion has a first link end that is connected to the first contact portion and a second link end that is connected to the second contact portion, and the first link end is disposed at a position deeper than the second link end in the at least one of the inserting directions.

12. The connector according to claim 11, further comprising a second housing that is different from the first housing, wherein the terminal has a second housing fixation portion that is fixed to the second housing and a movable portion that displaceably supports the first housing with respect to the second housing, the first contact portion has a first fixation portion that is fixed to the first terminal-retaining portion, and the first fixation portion is disposed at a position between the first link end and the movable portion.

13. The connector according to claim 11, wherein the second contact portion has a spring contact portion that comes into contact with the connection object and presses the connection object and a second fixation portion that fixes the second contact portion to the second terminal-retaining portion, and the second fixation portion is disposed at a position between the second link end and the spring contact portion.

14. The connector according to claim 13, further comprising a second housing that is different from the first housing, wherein the terminal has a second housing fixation portion that is fixed to the second housing and a movable portion that displaceably supports the first housing with respect to the second housing, the first contact portion has a first fixation portion that is fixed to the first terminal-retaining portion, and the first fixation portion is disposed at a position between the first link end and the movable portion.

* * * * *